US005611819A

United States Patent [19]

Nomura et al.

[11] Patent Number: 5,611,819

[45] Date of Patent: Mar. 18, 1997

[54] FABRIC SUPERIOR IN ANTI-DRAPE STIFFNESS, STIFFNESS AND SOFT HANDLE, AND MANUFACTURE THEREOF

[75] Inventors: Yasuhiko Nomura, Iwakuni; Ikuharu Nishida, Osaka; Tadaaki Kashima, Ise, all of Japan

[73] Assignee: Toyo Boseki Kabushiki Kaisha, Osaka, Japan

[21] Appl. No.: 615,866

[22] Filed: Mar. 14, 1996

Related U.S. Application Data

[62] Division of Ser. No. 516,482, Aug. 17, 1995, Pat. No. 5,534,336.

[30] Foreign Application Priority Data

| | | | |
|---|---|---|---|
| Aug. 22, 1994 | [JP] | Japan | 6-196820 |
| Aug. 25, 1994 | [JP] | Japan | 6-200798 |

[51] Int. Cl.[6] ..... D06P 5/00; D06P 5/02; D03D 3/00

[52] U.S. Cl. ..... 8/529; 8/401; 8/499; 8/930; 428/397

[58] Field of Search ..... 8/401, 444, 499, 8/506, 529, 920, 930; 428/229, 397

[56] References Cited

U.S. PATENT DOCUMENTS

| | | | |
|---|---|---|---|
| 4,367,070 | 1/1983 | Hayashi et al. | 8/115.7 |
| 5,134,031 | 7/1992 | Kagechi et al. | 8/478 |
| 5,487,936 | 3/1994 | Collier | 8/529 |

*Primary Examiner*—Paul Lieberman
*Assistant Examiner*—Caroline L. Dusheck
*Attorney, Agent, or Firm*—Leydig, Voit & Mayer, Ltd.

[57] ABSTRACT

A fabric superior in anti-drape stiffness, stiffness and soft handle, which is formed using a spun yarn comprising regenerated fibers having an average polymerization degree of not less than 400 and a modified cross-section, in a proportion of at least 20% by weight of the yarn, wherein at least one regenerated fiber from among the regenerated fibers of said fabric is split and/or fibrilar. According to the present invention, a fabric having a dry touch, which is superior in anti-drape stiffness, stiffness and soft handle, and a method for manufacture thereof are provided.

4 Claims, 3 Drawing Sheets

FABRIC SUPERIOR IN ANTI-DRAPE STIFFNESS, STIFFNESS AND SOFT HANDLE, AND MANUFACTURE THEREOF

This is a divisional of copending application(s) Ser. No. 08/516,482 filed on Aug. 17, 1995, now U.S. Pat. No. 5,534,336.

FIELD OF THE INVENTION

The present invention relates to a fabric having anti-drape stiffness, stiffness, dry touch and soft handle and superior in drape property, and manufacture thereof.

BACKGROUND OF THE INVENTION

In recent years, various materials for ladies' wears have emerged, and woven fabrics made from regenerated fibers such as cuprammonium rayon and polynosic have been numerously marketed.

However, these woven fabrics are poor in anti-drape stiffness and stiffness, and are slippery, since they are made from regenerated fibers having a round cross-section. Some of them were applied with a so-called bio treatment, which only resulted in poor anti-drape stiffness and stiffness, and unsatisfactory softness and drape property.

SUMMARY OF THE INVENTION

The present invention aims at solving the defects of the conventional fabrics manufactured from regenerated fibers, namely, poor anti-drape stiffness, poor stiffness and slippery touch, and providing a fabric superior in drape property and dimensional stability, which has a dry touch and superior anti-drape stiffness, stiffness and soft handling touch, as well as a method for manufacture thereof.

Accordingly, the present invention provides:

(1) a fabric superior in anti-drape stiffness, stiffness and soft handle, which is formed using a spun yarn comprising regenerated fibers having an average polymerization degree of not less than 400 and a modified cross-section, in a proportion of at least 20% by weight of the yarn, wherein at least one regenerated fiber from among the regenerated fibers of said fabric, is split and/or fibrilar, (2) the fabric of the above (1), wherein a degree of the modified cross-section is 0.10–0.95, (3) the fabric of the above (1), wherein the modified cross-section is triangular, (4) a method for manufacture of a fabric superior in anti-drape stiffness, stiffness and soft handling touch, comprising weaving or knitting a spun yarn comprising regenerated fibers having an average polymerization degree of not less than 400 and a modified cross-section, in a proportion of at least 20% by weight of the yarn, treating the obtained woven fabric or knit fabric with an enzyme, and dyeing same using a jet dyeing machine, (5) the method of the above (4), further comprising light gigging the fabric before the enzyme treatment, (6) the method of the above (4), comprising light gigging the fabric after the dyeing, and (7) the method of the above (4), comprising light gigging the fabric both before the enzyme treatment and after the dyeing.

DETAILED DESCRIPTION OF THE INVENTION

The present invention is described in detail in the following. In the present invention, a regenerated fiber having a viscosity average degree of polymerization of not less than 400 is used for the reason that shrinkage due to washing can be reduced and dimensional stability and fiber strength can be enhanced. Examples of the regenerated fiber include polynosic fiber, cuprammonium rayon fiber and so on, with preference given to polynosic fiber for achieving dimensional stability.

The regenerated fiber having the aforementioned average degree of polymerization of not less than 400 should have a modified cross-section. The modified cross-section imparts anti-drape stiffness and stiffness, removes slipperiness and gives dry touch handle to the fabric.

Figure 1:
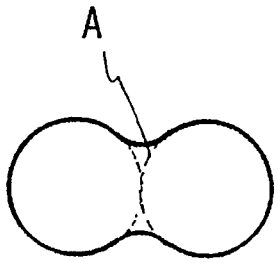
FIG. 1 is a cross-section of a fiber having a cocoon cross-section, wherein A is a fiber split boundary line.
Figure 4:
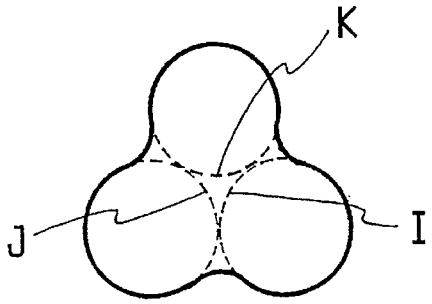
FIG. 4 is a cross-section of a fiber having another triangular cross-section, wherein I, J and K are fiber split boundary lines.
Figure 2:
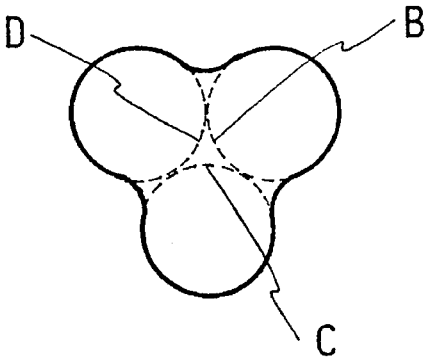
FIG. 2 is a cross-section of a fiber having a triangular cross-section, wherein B, C and D are fiber split boundary lines.
Figure 5:
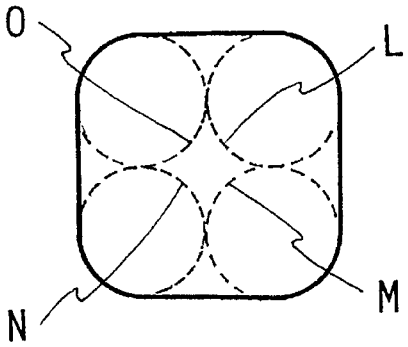
FIG. 5 is a cross-section of a fiber having another square cross-section, wherein L, M, N and O are fiber split boundary lines.
Figure 3:
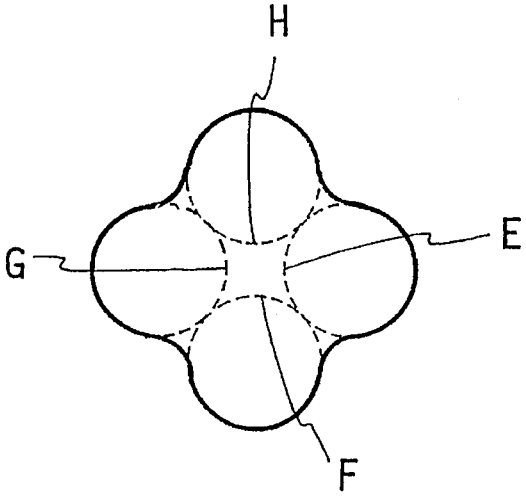
FIG. 3 is a cross-section of a fiber having a square cross-section, wherein E, F, G and H are fiber split boundary lines.

Examples of the modified cross-section include those shown in FIGS. 1–5, wherein FIG. 1 shows a cocoon cross-section, FIG. 2 shows a triangular cross-section, FIG. 3 shows a square cross-section, FIG. 4 shows a modified triangular cross-section and FIG. 5 shows a square cross-section.

Figure 6:
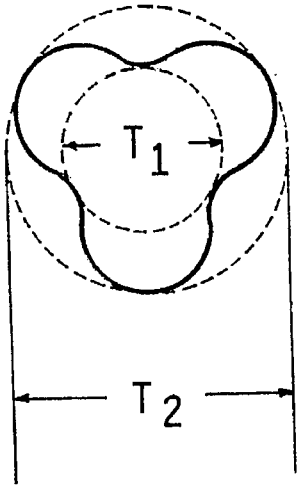
FIG. 6 is a cross-section of a fiber having a triangular cross-section, which explains the degree of modified cross-section.

The degree of the modified cross-section is expressed by $T_1/T_2$ wherein $T_2$ is a circumscribed circle diameter (mm) and $T_1$ is an inscribed circle diameter (mm), as shown in FIG. 6.

When the degree of modification is less than 0.10, anti-drape stiffness and stiffness tend to be insufficient and the fabric tends to become slippery, whereas that exceeding 0.95 undesirably results in difficult spinning. The preferable range is 0.10–0.95, more preferably 0.20–0.95, particularly preferably 0.30–0.95, and most preferably 0.30–0.75.

The aforementioned regenerated fiber preferably has a fineness of 0.7–3 deniers, more preferably 1–3 deniers and particularly preferably 1.2–2.5 deniers. The fiber length is 28–72 mm, more preferably 32–51 mm.

When the fiber has a fineness of less than 0.7 denier, anti-drape stiffness and stiffness tend to become insufficient. On the other hand, that exceeding 3 deniers results in rustlingly poor handling touch. When the fiber length is less than 28 mm, the yarn strength undesirably decreases, whereas that more than 72 mm leads to undesirably long hair length. It does not matter whether the fiber is cut in a uniform length or a non-uniform length.

The above-mentioned regenerated fiber in the form of staples is contained in a proportion of at least 20% by weight of the yarn, and forms a spun yarn.

The use of 100% by weight of such regenerated fiber is preferable in that silky touch can be made strong.

The regenerated fiber can be spun into a spun yarn in combination with another fiber, preferably a polyester fiber. In this case, the spun yarn consists of the regenerated fiber in a proportion of 20% by weight to 80% by weight and another fiber in a proportion of 80% by weight to 20% by weight. When the regenerated fiber is contained in a proportion of less than 20% by weight, the characteristic features of the regenerated fiber undesirably become difficult to show.

The mixing state of said regenerated fiber and another fiber is exemplified by a blended spun yarn wherein the both are blended in staples, a spun yarn of a core-sheath two layer structure wherein the core is made from polyester staples and the sheath is made from regenerated fiber staples, a twisted union yarn or plied yarn wherein two blended roving yarns are twisted or plied by a spinning frame, and a spun yarn manufactured by mixing the regenerated staple fibers and polyester filament fibers.

The twist coefficient of the spun yarn is preferably 2.5–5.5, more preferably 3.0–5.0 by an inch method. When it is less than 2.5, fluff grows in number and drape property becomes poor, whereas when it is more than 5.5, the yarn undesirably comes to have stiff handle and poor drape property.

While the above-mentioned spun yarn forms a fabric such as woven fabric and knit fabric, at least one regenerated fiber of the regenerated fibers contained in the fabric should be split and/or fibrilar.

The presence of fibrils makes the surface touch of the fabric soft, and that of splits increases soft touch of the fabric. Partial splitting of at least one regenerated fiber emphasizes the soft touch of the surface of the fabric. Being split is the state where, for example, in the cocoon cross-section as shown in FIG. 1, the fiber splits along a line A (fiber split boundary line) and the split fibers join at a certain point in the longitudinal direction (the direction toward the drawing) of the fiber (see FIG. 7). The fiber is not necessarily split along the entirety of the fiber boundary line, but may be partly split.

Figure 7:
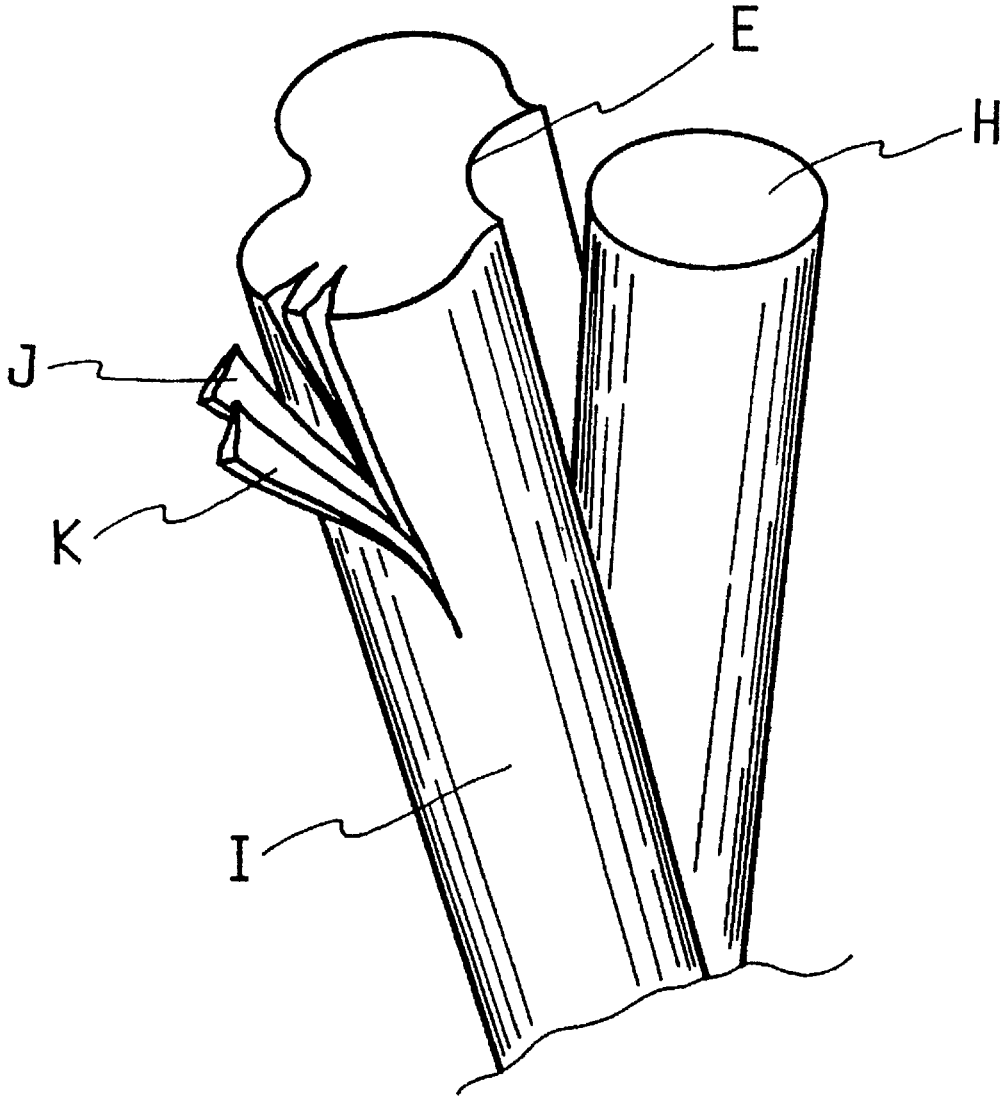
FIG. 7 is a perspective view of a fiber having a triangular cross-section, wherein the fiber has fibrils and a split.

In the triangular cross-section of FIG. 2, the split may be developed along the split fiber boundary line B, C or D, or a combination thereof, or along all of said lines, and the split fibers join at a certain point in the longitudinal direction thereof (the direction toward the drawing). The same applies to FIGS. 3, 4, 5 and 6. In FIG. 7, the split occurs along the line E. One end of the split portion H is separated from the fiber body I, and the other end joins the fiber body I.

Figure 8:
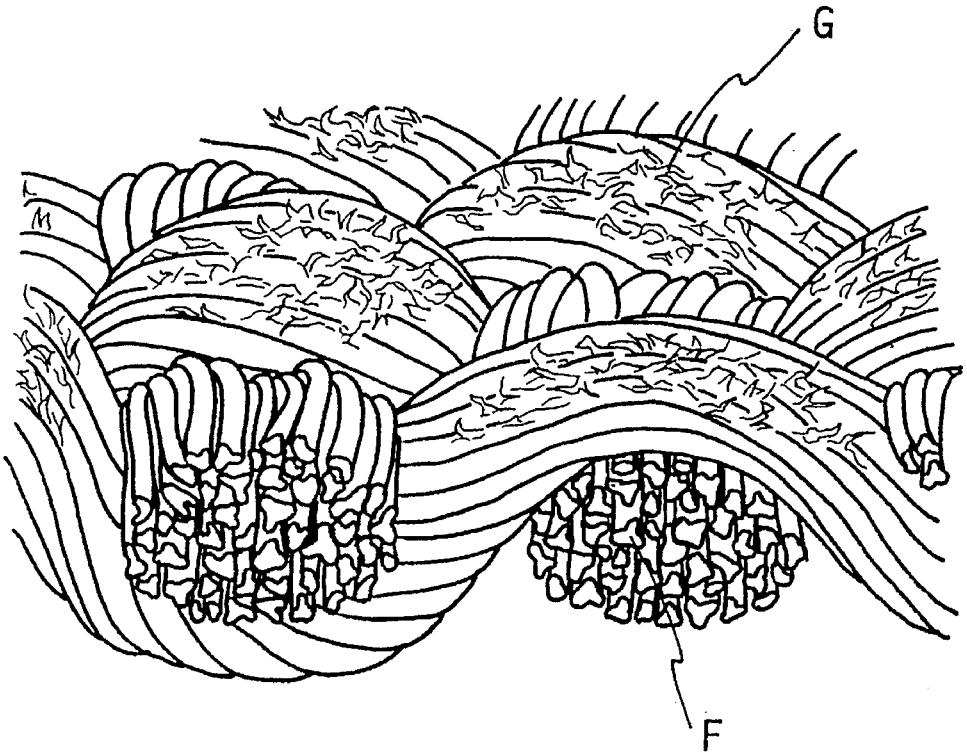
FIG. 8 is a perspective view of a portion of a fiber having fibrils and splits.

Having fibrils is the state where, in FIG. 7, for example, one end of fibrils J and K are separated from the fiber body I and the other end of the fibrils join said fiber body I. FIG. 8 is a perspective view showing part of the fabric, wherein G is a fibril and F is a split.

The Figures described above are for explanation purposes, and modification can be made as long as the spirit of the present invention is not impaired.

The manufacture method of the fabric of the present invention is explained in the following.

First, a woven fabric or knit fabric is produced using a spun yarn comprising regenerated fibers having an average polymerization degree of not less than 400 and a modified cross-section, in a proportion of at least 20% by weight of the yarn, as warp and/or weft.

Then, the knit or woven fabric thus produced is treated with an enzyme, dyed using a jet dyeing machine, and subjected to a finishing treatment.

This enzyme treatment aims at relaxing the fiber tightness of the fabric, thereby improving drape property and imparting flexible handle, and is performed by, for example, desizing, scouring and treating in a warm bath at 50° C. containing 5 g/l ENZYLON CM-10 as an enzyme at a bath ratio of 1:30 for 1 hour. The pH at this treatment is 4.5 and the fabric is washed with warm water at 80° C. for 15 minutes.

A part of the regenerated fiber having a modified cross-section (e.g. triangular cross-section) becomes split and/or fibrilar by a light gigging treatment such as emery gigging which is performed before the enzyme treatment, and subjecting the regenerated fibers to caustic reduction by enzyme treatment, or light gigging treatment after dyeing, or light gigging treatment both before the enzyme treatment and after the dyeing, so that the fabric is imparted with peach touch, soft touch, moderate anti-drape stiffness and stiffness.

The dyeing using a jet dyeing machine aims at obtaining handle with bulkiness, and making fibrils and splits.

The finishing treatment is performed by a conventional method. Where necessary, resin finishing and water repellency finishing are also performed.

The present invention is explained in more detail by way of Examples. The determination methods used in Examples are shown in the following.

(a) Viscosity Average Polymerization Degree

According to JIS L1015–1992, 7.29 average polymerization degree, the determination is performed using an OKEN type viscometer while shutting out the air by a nitrogen gas flow.

(b) Degree of Modified Cross-section

Fibers are drawn in uniformity and fixed by applying a resin on the circumference thereof to give a fiber sample.

Stippling is performed using a microscope equipped with a stippling device at a magnitude of 600. The number of stipples is n=100. With regard to the stipples at 100 points, an inscribed circle diameter $T_1$ (mm), a circumscribed circle diameter $T_2$ (mm) are measured using a tin plate. $T_1/T_2$ of each stipple is determined, and the average value is taken as the degree of modified cross-section.

(c) Handle (Dry Touch)

Determined by a sensuous test according to the degree of dry touch as judged by ten people. The evaluation is in accordance with the number of people who judged dry touch handle, and expressed by the symbols ⊙: 9 or 10 people, ○: 6 to 8 people, Δ: 4 or 5 people and X: 3 people or less.

(d) Handle (Soft Touch)

Determined by a sensuous test according to the degree of soft touch as judged by ten people. The evaluation is in accordance with the number of people who judged soft touch handle and expressed by the symbols ⊙: 9 or 10 people, ○: 6 to 8 people, Δ: 4 or 5 people and X: 3 people or less.

(e) Anti-drape Stiffness and Stiffness

Bending resistance Is determined according to JIS L 1096, A method (45° cantilever method). Five test specimens (2 cm×15 cm) are each taken from the longitudinal direction and the transverse direction of a fabric. They are slid with the surface up, and the average values obtained are taken as the target values. The test specimens are slid with hand.

(f) Drape Coefficient

Drape coefficient is determined according to JIS L 1096, G method. To be specific, five round test specimens having a diameter of 25.4 cm are taken, and a hole (1 cm) is formed in the center of the each test specimen. The test specimens are placed on a test table (diameter 12.7 cm) of a drape tester with the determination surface side up, and the test table is vibrated up and down three times. The specimens are left standing for 1 minute, and the area of the drape at that time is measured. The coefficient is obtained using the formula of:

$$\text{Drape coefficient}=(A_d-S_1)/(S_2-S_1)$$

wherein $A_d$ is a perpendicularly projected area (drape area, $mm^2$) of the test specimens, $S_1$ is the area ($mm^2$) of the test table, and $S_2$ is the area ($mm^2$) of the test specimens.

(g) Crease Resistance

JIS L 1059, B method (Monsanto method)

Ten test specimens (15 mm×40 mm) are each taken from the longitudinal direction and the transverse direction of the fabric, and held by a metal plate holder of a Monsanto tester. The portion sticking out from the upper short plate is folded back. Five of the specimens are held face to face by a press holder and the remaining five back to back, and applied with a load of 500 g for 5 minutes. The load is lifted, and the above-mentioned holder is inserted in a tester holder. The turntable is turned so that the suspending portion of the test specimen is always in line with the central line of the tester, and an open angle x of the test specimen is measured 5 minutes later. With regard to the specimens taken from the longitudinal direction, the average values of the 5 faces and the 5 backs and the proportion (%) to 180 are used to show the crease resistance. With regard to the specimens taken from the transverse direction, the average values of the 5 faces and the 5 backs and the proportion (%) to 180 are used.

(h) Dimensional Stability [Shrinkage After Washing (%)]

According to JIS L 1042, F-1 method, water (ca. 40° C.) in an amount sufficient to cover two 50 cm×50 cm test specimens marked with a mark ($L_1$) of 45 cm and a mark ($L_2$) of 45 cm is poured in a washing machine, and the two test specimens and other cloth in a total weight of 1.36 kg are cast in. At the same time, a powder detergent, No. 1, defined in JIS K 3303 is added to give an about 0.1% by weight solution thereof, and the washing machine is run for 15 minutes. The solution is changed to fresh water (ca. 40° C.), and the washing machine is run for 5 minutes. Then, water is changed to fresh water (ca. 40° C.), and the washing machine is run for 10 minutes. After draining, the test specimens are taken out and dried hanging.

After drying, the mark $L_1'$ corresponding to $L_1$ on the test specimen and the mark $L_2'$ corresponding to $L_2$ thereon are measured, and the formula $\{(L_1-L_1')/L_1\}\times100$ is applied to the specimens taken from the longitudinal direction and the formula $\{(L_2-L_2')/L_2\}\times100$ is applied to the specimens taken from the transverse direction. The average values of the two specimens are taken to show the stability.

EXAMPLE 1

Figure 9:
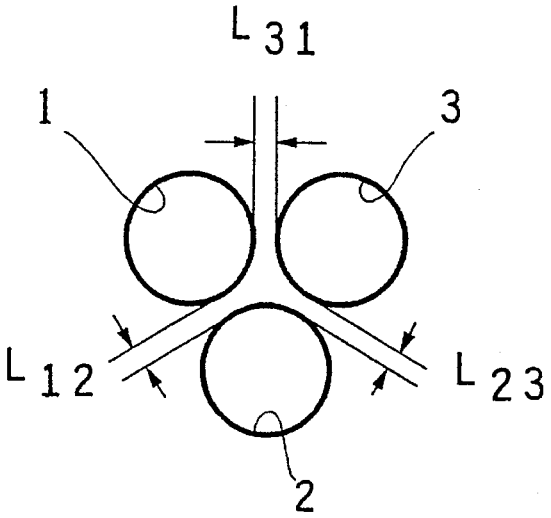
FIG. 9 is a plane view of a spinning nozzle comprising a round small holes 1, 2 and 3 for spinning the fiber of FIG. 2 having a triangular cross-section, wherein $L_{12}$, $L_{23}$ and $L_{31}$ show the distance between the small holes, which varies from 0 mm to 0.02 mm.

Using the spinneret shown in FIG. 9, polynosic fibers having a triangular cross-section as shown in FIG. 2, average degree of polymerization of 500 and various finenesses were manufactured. In FIG. 9, the symbols 1, 2 and 3 are small round holes and $L_{12}$, $L_{23}$ and $L_{31}$ are distances between the holes. The manufacture conditions were as follows.

Total small hole area ($mm^2$): 0.0020 $mm^2$, 0.0035 $mm^2$, 0.0058 $mm^2$, 0.0087 $mm^2$ and 0.0094 $mm^2$, for respective fibers; output amount (g/min·hole): 294 g/min·hole, 504 g/min·hole, 840 g/min·pore, 1260 g/min·hole and 1345 g/min·hole, respectively; and shear speed ($sec^{-1}$): $4.0\times10^4$ $sec^{-1}$, $3.1\times10^4$ $sec^{-1}$, $2.4\times10^4$ $sec^{-1}$, $1.9\times10^4$ $sec^{-1}$ and $1.8\times10^4$ $sec^{-1}$, respectively.

The spinning speed (m/min) was 23 m/min, hole length (mm) of small hole groups was 1.8 mm (a group comprising plural holes set together to form a modified cross-section, hereinafter the same), output linear speed (m/min) was 15.3 m/min, nozzle draft was 1.0 fold, $L_{12}$, $L_{23}$ and $L_{31}$ were all 0.01 mm and the number of the small hole groups was 27,000.

The polynosic fibers were cut into 38 mm identical length fibers, spun into respective spun yarns 20'S/1 (twist coefficient 3.7) using 100% by weight of said fiber. The yarns were used for warp and weft, and plane weaves of 60 yarns/inch ×50 yarns/inch were woven. The plane weaves were subjected to emery gigging using a paper gigging machine, desizing, scouring, enzyme treatment using a jet dyeing machine, dyeing by a jet dyeing machine at 85° C. for 85 minutes using a reaction dye (Kayacion Navy ECM, manufactured by Nihon Kagaku Corp.) in a dye bath containing 4.5% owf anhydrous sodium sulfate 67 g/l, soda ash 20 g/l, and Leport 350.2 g/l (non-ionic surfactant manufactured by Nikka Kagaku Corp.), and a finishing treatment.

The results are shown in Table 1.

TABLE 1

| | No. | | | | | |
|---|---|---|---|---|---|---|
| item | 1 | 2 | 3 | 4 | 5 | 6 |
| STARTING FIBERS | | | | | | |
| fineness (denier) | 0.7 | 1.2 | 1.2 | 2.0 | 3.0 | 3.2 |
| fiber length (mm) | 38 | 38 | 38 | 51 | 51 | 51 |

TABLE 1-continued

| item | No. 1 | 2 | 3 | 4 | 5 | 6 |
|---|---|---|---|---|---|---|
| degree of modified cross-section | 0.20 | 0.25 | — | 0.30 | 0.35 | 0.40 |
| cross-section | tri-angle | tri-angle | round | tri-angle | tri-angle | tri-angle |
| FABRIC PROPERTY | | | | | | |
| dry touch handle | Δ | ○ | x | ◎ | ◎ | ◎ |
| soft touch handle | ◎ | ◎ | ○ | ◎ | ○ | Δ |
| anti-drape stiffness, stiffness (mm) | 28 | 32 | 29 | 35 | 38 | 40 |
| drape coefficient | 25 | 28 | 26 | 30 | 32 | 35 |

From the results of Table 1, the following was confirmed. In Table 1, the fabric No. 1 was somewhat inferior in dry touch handle due to the use of starting fibers having a denier not more than 1. The fabric No. 6 was manufactured using coarse size fibers, and had a dry touch handle. The fabric No. 3 had a round cross-section and was far from dry touch handle. The fabrics No. 2 and No. 4 had dry touch handle and soft surface touch. This is considered to be attributable to fibrils and splits of the fiber.

EXAMPLE 2

Using the spinneret shown in FIG. 9, a polynosic fiber having a triangular cross-section as shown in FIG. 2, degree of modified cross-section of 0.30, average degree of polymerization of 500 and fineness of 1.4 denier was manufactured. The manufacture conditions were as follows.

Total small hole area ($mm^2$): 0.004 $mm^2$; hole length (mm) of small hole groups: 1.8 mm; spinning speed (m/min): 23 m/min; output amount (g/min·hole): 588 g/min·hole; output linear speed (m/min): 15.3 m/min; shear speed ($sec^{-1}$): $2.9\times10^4$ $sec^{-1}$; nozzle draft: 1.0 fold; $L_{12}$, $L_{23}$ and $L_{31}$: all 0.01 mm; and the number of the small holes: 27,000.

The polynosic fiber was cut into 38 mm identical length fibers, spun into a roving of 100% by weight of said fiber. As a spun yarn, a twisted union yarn or plied yarn (30'S/1) was spun at a twist coefficient of 3.7 (20.3 t/in) using the roving in a ring spinning frame.

The yarn was used for warp and weft and a plane weave of 110 yarns/inch×80 yarns/inch was woven. The woven fabric was subjected to desizing, scouring, enzyme treatment as in Example 1 using a jet dyeing machine, dyeing using a reactive dye as in Example 1 by a jet dyeing machine and a finishing treatment, whereby a clothing fabric for ladies' dresses having anti-drape stiffness, stiffness, dry touch handle, soft surface handle and superior drape property was obtained.

EXAMPLE 3

Using the spinneret shown in FIG. 9, a polynosic fiber having a triangular cross-section as shown in FIG. 2, degree of modified cross-section of 0.30, average degree of polymerization of 500 and fineness of 1.8 denier was manufactured. The manufacture conditions were as follows.

Total small hole area ($mm^2$): 0.0052 $mm^2$; hole length (mm) of small hole groups: 1.8 mm; spinning speed (m/min): 23 m/min; output amount (g/min·hole): 757 g/min·hole; output linear speed (m/min): 15.3 m/min; shear speed ($sec^{-1}$): $2.5\times10^4$ $sec^{-1}$; nozzle draft: 1.0 fold; $L_{12}$, $L_{23}$ and $L_{31}$: all 0.01 mm; and the number of the small holes: 27,000.

The polynosic fiber was cut into 51 mm identical length fibers, spun into a roving of 100% said starting fiber. Meanwhile, polyester fibers (staples or filaments) were mixed in a ring spinning frame to give a blended yarn and a twisted union yarn or plied yarn (20'S/1) as spun yarns. These yarns were used for warp and/or weft and a plane weave of 110 yarns/inch×80 yarns/inch was woven. The woven fabric was subjected to emery gigging, desizing, scouring, enzyme treatment using a jet dyeing machine, dyeing by a jet dyeing machine (conditions: the polynosic fiber was dyed with a reactive dye and the polyester fiber was dyed with a disperse dye) and a finishing treatment. The obtained fabric was evaluated, the results of which are shown in Table 2.

TABLE 2

| | No. 1 | 2 | 3 | 4 | 5 |
|---|---|---|---|---|---|
| STARTING FIBERS | | | | | |
| polynosic fiber | | | | | |
| cross-section | tri-angle | tri-angle | tri-angle | tri-angle | round |
| degree of modified cross-section | 0.30 | 0.30 | 0.30 | 0.30 | — |
| fineness (denier) | 1.8 | 1.8 | 1.8 | 1.8 | 1.8 |
| weight (%) | 70 | 58 | 90 | 10 | 70 |
| polyester fiber | | | | | |
| cross-section | round | round | round | round | round |
| fineness (denier) | staple 1.4d | filament 75d/24f | staple 1.4d | staple 1.4d | staple 1.4d |
| weight (%) | 30 | 42 | 10 | 90 | 30 |
| yarn | blend | twisted union | blend | blend | blend |
| FABRIC | | | | | |
| dry touch handle | ◎ | ◎ | ◎ | Δ | x |
| soft touch handle | ◎ | ○ | ◎ | Δ | ○ |
| anti-drape stiffness, stiffness (mm) | 68 | 56 | 70 | 48 | 50 |
| drape coefficient | 35 | 38 | 32 | 30 | 28 |
| crease resistance (%) | 75 | 85 | 68 | 90 | 62 |
| dimensional stability (%) length | 2.7 | 2.5 | 2.5 | 2.3 | 2.8 |
| dimensional stability (%) breadth | 1.8 | 1.2 | 1.9 | 1.0 | 1.9 |

From the results of Table 2, the following was confirmed. In Table 2, the fabrics No. 1–No. 4 were blended yarns (20'S) and twisted union yarn or plied yarn (20'S) manufactured using 1.8 denier, 51 mm length polynosic fibers having a triangular cross-section and 1.4 denier polyester staples or polyester multifilament yarns (75 denier, 24 filaments) in combination.

These yarns were woven into plain weaves, and the weaves were dyed, processed and subjected to evaluation of fabric property. The fabric No. 5 was manufactured using fibers having a round cross-section. The fabric Nos. 1–3 were superior in dry touch handle and soft touch handle. The fabric No. 4 was slippery, and the fabric No. 5 scarcely had dry touch handle. The fabric Nos. 1 and 2 showed superior anti-drape stiffness and stiffness; the fabric No. 3 had somewhat strong anti-drape stiffness and stiffness; and the fabric Nos. 4 and 5 were insufficient in anti-drape stiffness and stiffness. With regard to drape property of the fabric, the range of from 32 to 38 is preferable. The fabric Nos. 3 and 5 had poor crease resistance. On the whole, the fabric Nos. 1, 2 and 3 satisfied all check items.

The fabric of the present invention has a dry touch and is rich in soft touch handle. It is superior in anti-drape stiffness, stiffness, crease resistance and dimensional stability. The method of the present invention ensures manufacture of the above-mentioned fabric with good reproducibility.

What is claimed is:

1. A method of manufacture of a fabric superior in anti-drape stiffness, stiffness and soft handle, comprising weaving or knitting a spun yarn comprising at least 20% by weight of the yarn of regenerated fibers to form a woven or knit fabric, wherein said regenerated fibers have an average polymerization degree of not less than 400 and a modified cross-section selected from the group consisting of cocoon, triangular and square cross-sections, and wherein the degree of modification of the cross-section is from 0.10–0.95, treating the obtained woven fabric or knit fabric with an enzyme, and dyeing the fabric with a jet dyeing machine.

2. The method of claim 1, further comprising light gigging the fabric before the enzyme treatment.

3. The method of claim 1, comprising light gigging the fabric after the dyeing.

4. The method of claim 1, comprising light gigging the fabric both before the enzyme treatment and after the dyeing.

* * * * *